US005507325A

United States Patent [19]

Finlayson

[11] Patent Number: 5,507,325

[45] Date of Patent: Apr. 16, 1996

[54] VAPOR RECOVERY SYSTEM FOR FUEL DISPENSERS

[76] Inventor: Ian M. Finlayson, 613 Douglas Rd., Salisbury, Md. 21801

[21] Appl. No.: 153,627

[22] Filed: Nov. 17, 1993

[51] Int. Cl.[6] ..... B67D 5/378

[52] U.S. Cl. ..... 141/83; 141/59; 141/95; 141/96; 73/23.2; 73/31.02

[58] Field of Search ..... 141/51, 59, 83, 141/95, 96, 290, 302; 73/23.2, 31.02

[56] References Cited

U.S. PATENT DOCUMENTS

| | | | |
|---|---|---|---|
| 2,401,124 | 5/1946 | Walker et al. . | |
| 3,016,928 | 1/1962 | Brandt | 141/45 |
| 3,273,584 | 9/1966 | Kennepohl | 137/209 |
| 3,581,782 | 6/1971 | Onufer | 141/59 |
| 3,763,901 | 10/1973 | Viland | 141/8 |
| 3,815,327 | 6/1974 | Viland | 55/80 |
| 3,826,291 | 7/1974 | Steffens | 141/59 |
| 3,850,208 | 11/1974 | Hamilton | 141/59 |
| 3,881,528 | 5/1975 | Mackenzie | 141/52 |
| 3,881,894 | 5/1975 | Onufer | 55/88 |
| 3,899,009 | 8/1975 | Taylor | 141/59 |
| 3,905,405 | 9/1975 | Fowler et al. | 141/46 |
| 3,913,633 | 10/1975 | Hiller | 141/45 |
| 3,915,206 | 10/1975 | Fowler et al. | 141/59 |
| 3,916,961 | 11/1975 | Dilger | 141/95 X |
| 3,941,168 | 3/1976 | Hillet et al. | 141/46 |
| 3,952,781 | 4/1976 | Hiller et al. | 141/46 |
| 3,981,334 | 9/1976 | Deters et al. | 141/46 |
| 4,020,861 | 5/1977 | Shihabi | 137/100 |
| 4,056,131 | 11/1977 | Healey | 141/206 |
| 4,057,085 | 11/1977 | Shihabi | 141/159 |
| 4,057,086 | 11/1977 | Healy | 141/206 |
| 4,058,147 | 11/1977 | Stary et al. | 141/45 |
| 4,068,687 | 1/1978 | Long | 141/59 |
| 4,082,122 | 4/1978 | McGahey | 141/5 |
| 4,095,626 | 6/1978 | Healy | 141/206 |
| 4,153,073 | 5/1979 | Deters | 137/493.4 |
| 4,166,485 | 9/1979 | Wokas | 141/52 |
| 4,167,958 | 9/1979 | Voelz | 141/95 |
| 4,197,883 | 4/1980 | Mayer | 141/59 |
| 4,199,012 | 4/1980 | Lasater | 141/52 |
| 4,202,385 | 5/1980 | Voelz et al. | 141/59 |
| 4,223,706 | 9/1980 | McGahey | 141/59 |
| 4,253,503 | 3/1981 | Gunn | 141/59 |
| 4,256,151 | 3/1981 | Gunn | 141/59 |
| 4,260,000 | 4/1981 | McGahey et al. | 141/59 |
| 4,273,164 | 6/1981 | Gunn | 141/7 |
| 4,295,505 | 10/1981 | Hasselmann et al. | 141/301 |
| 4,306,594 | 12/1981 | Planck | 141/59 |
| 4,310,033 | 1/1982 | Deters | 141/44 |
| 4,517,161 | 5/1985 | Gravina et al. | 73/23.2 |

(List continued on next page.)

FOREIGN PATENT DOCUMENTS

| | | |
|---|---|---|
| 3613453C2 | 4/1988 | Germany . |
| 8717378 U | 9/1988 | Germany . |
| 3903603A1 | 8/1990 | Germany . |
| 2014544A | 8/1979 | United Kingdom . |

OTHER PUBLICATIONS

Gasoline Vapor Control is Easy . . . Hirt Combustion Engineers Jun. 1986.

The system designed with convenience in mind. Gulf Undated.

Vapours Recovery System NuovoPignone Mar. 10, 1990.

*Primary Examiner*—J. Casimer Jacyna

[57] ABSTRACT

A dispenser for volatile liquids with a vapor collection system is disclosed which controls the rate of operation of a vacuum pump 118 so that a simple vacuum intake 148 disposed preferably inside, but not sealed with, the filler neck can be used to collect only the vapors displaced from the fuel tank 110 by the fuel 104. The vacuum pump 118 is controlled by a controller 114 which receives, from various sensors 124, 128, 132 and 136, signals representative of the fuel vapor/air ratio immediately outside the tank, inside the tank, and/or inside the vapor recovery conduit 122, and/or of the pressure relative to atmosphere inside the tank 110 and/or of the rate of flow of liquid being dispensed. Based on these input signals, the controller 114 operates the vacuum pump 118 at an optimal rate to collect fuel vapor displaced from the tank 110.

8 Claims, 2 Drawing Sheets

4,649,970 3/1987 Bower ..... 141/302
5,038,838 8/1991 Bergamini et al. ..... 141/59
5,040,577 8/1991 Pope ..... 141/59
5,123,817 6/1992 Willemsen ..... 417/404
5,156,199 10/1992 Hartsell et al. ..... 141/83
5,195,564 3/1993 Spalding ..... 141/59 X
5,209,275 5/1993 Akiba et al. ..... 141/83
5,269,353 12/1993 Nanaji et al. ..... 141/59
5,291,922 3/1994 Martin et al. ..... 141/59

VAPOR RECOVERY SYSTEM FOR FUEL DISPENSERS

TECHNICAL FIELD OF THE INVENTION

This invention relates generally to volatile liquid dispensers and dispensing systems of the type used to dispense gasoline into automotive fuel tanks, and more particularly relates to a method for collecting, during the use of such dispensers, the displaced vapors of the dispensed liquids, and to a dispenser or dispensing system which includes a vapor collecting system.

BACKGROUND OF INVENTION

As an automobile is being fueled with gasoline at a service station, gasoline flowing into the fuel tank displaces gasoline vapor which, unless collected, escapes into the atmosphere. Such vapors not only contribute to atmospheric pollution, but also are unpleasant to the person operating the nozzle, and may adversely affect the person's health over a longer term. As a result, some governmental authorities forbid releasing these vapors into the atmosphere and require collection of any excess vapor for retention and recycling. In the past, various systems have been proposed and used for collecting and returning these vapors to a storage vessel, typically the underground storage tank from which the gasoline is being dispensed. The vapors thus stored are typically then collected for subsequent disposal by the over-the-road tanker when it delivers additional fuel to the storage tank, or are disposed of by other means.

In one such prior art system, the dispensing pump nozzle is sealed to the fuel tank filler neck so that the displaced fuel vapor is directed to the underground storage tank by way of an annular conduit around the nozzle, a coaxial dual conduit hose attached to the nozzle, and appropriate attached plumbing. The design of the nozzle necessary to effect such a seal to the fuel tank filler neck has generally involved the addition of a bellows around the nozzle spout which operates to seal the annular vapor recovery passageway to the filler neck of the tank, as well as various other modifications which make the hand-held nozzle heavy and cumbersome, thereby causing the fueling process to be quite difficult, onerous and unreliable, particularly for the self-serve motorist.

The problems relating to sealable bellows nozzles have been somewhat mitigated by a system which utilizes a vacuum pump to assist in the collection of excess fuel vapor and its transfer to the storage tank. As a result of the use of the vacuum pump, it is unnecessary to seal the vapor recovery passageway to the filler neck of the tank with a bellows, hence reducing the weight of the nozzle and simplifying the fueling process. In this "bellowless" system, the vacuum vapor recovery inlet need only be placed in close proximity to the filler neck of the fuel tank. However, it is very important in this system that the volume of gaseous mixtures drawn in through the vapor recovery vacuum inlet closely approximate the volume of vapor being displaced by the gasoline flowing into the fuel tank. If the volume of vapor being collected is less than that discharged from the tank, it will obviously result in some vapor escaping into the atmosphere. On the other hand, if the volume of vapor collected is greater than the volume discharged from the fuel tank, excess air may be recovered with the vapors, which can create a hazardous vapor/air mixture in the storage tank.

One previous bellowless system controls the appropriate ratio of excess fuel vapor recovered to fuel dispensed by a positive displacement vacuum pump which is driven by a hydraulic motor, which is in turn driven by the flow of gasoline being dispensed into the fuel tank. A major disadvantage of this type system is that a relatively expensive pump unit is required for each dispensing hose or nozzle. In addition, the large number of individual nozzles associated with each typical multi-grade dispensing unit results not only in complex and expensive plumbing, but also occupies substantial space. Thus, the total cost of such a system is a deterrent to its widespread adoption. Also, the hydraulic motor causes an undesirable drop in the pressure (and hence the flow rate) of the gasoline.

A second previous bellowless system measures the rate of flow of gasoline dispensed into the fuel tank and operates an electrically driven vapor pump at a rate having a fixed relationship to the flow of gasoline, modified only by the measured pressure on the intake side of the vapor pump. For example, if empirical data indicate that on average 300 cubic inches of fuel vapor are displaced for every gallon of fuel dispensed, the vapor pump would be controlled to draw 300 cubic inches of vapor for every gallon of fuel dispensed.

A third previous bellowless system measures the temperature of the gasoline in the storage tank, the temperature of the recovered vapors, and the density of the recovered vapors. From these measurements, the system calculates the proper rate at which to drive a vapor recovery pump.

All of these prior art systems suffer from similar disadvantages. They rely on a calculation based on a pre-set formula derived from average empirical data in order to determine how much vapor should be recovered from the fuel tank. The accuracy of the vapor recovery rate is determined only by the accuracy of the formula, and is not verified during operation. The first and second systems do not take temperature of the system into account, which can affect the amount of fuel vapor displaced. None of the prior art systems can self adjust for different grades of fuel or for variations within the same grade. Also, these systems cannot reliably prevent the escape of significant amounts of fuel vapors to the atmosphere since such escape is not detected directly.

SUMMARY OF THE INVENTION

The present invention overcomes the disadvantages of the prior art systems in that it provides a system which eliminates the necessity of a seal between the vapor collection line and the filler neck of the fuel tank, yet provides an economical and exact system for collecting only the correct volume of vapors for the amount of liquid being dispensed. The present invention is not controlled by calculations based on average empirical measurements.

In accordance with an embodiment of the present invention, a volatile liquid such as gasoline is pumped from a storage tank through a flow meter and dispensed through an on-demand nozzle by the customer into the fuel tank of a vehicle. Vapors displaced from the tank are collected through a vapor intake, preferably disposed concentrically with the nozzle and terminating near the end of the filler neck of the tank; and pumped by an electric motor driven vacuum pump to a vapor storage tank, preferably the fuel storage tank. The flow meter produces an electrical signal representative of the liquid volume flow rate. Vapor to air ratio sensors produce signals representative of the vapor to air ratio at one or more of three possible points: immediately outside the tank opening, inside the tank, and inside the vapor return line. A pressure sensor produces a signal representative of the pressure relative to atmosphere inside the tank. A controller receives the various signals and operates the vacuum pump at a rate determined by rate of flow of liquid, as modified to minimize the vapor to air ratio immediately outside the tank, to maximize the vapor to air ratio inside the vapor intake and inside the tank, or to minimize the negative pressure inside the tank. Thus the invention provides for direct measurement of the performance of the vapor recovery system, and for direct and continuous optimization of that performance, more accurately, reliably and efficiently than in previous systems.

In one form of the invention a dispensing system for dispensing volatile liquids such as hydrocarbon fluids for vehicles while collecting vapors to reduce atmospheric pollution is disclosed, comprising at least one liquid dispensing means, each liquid dispensing means comprising: a nozzle and liquid valve means for flowing liquid into a tank, vapor collection means, associated with the nozzle and liquid valve means, for collecting the vapors displaced from the tank during filling and at least one sensor means, associated with the nozzle and liquid valve means, for directly monitoring operation of the vapor collection means at the nozzle and liquid valve means and for providing signals representative of the operation, and controller means for receiving the signals from each of the respective at least one sensor means and operating the respective vapor collection means at individually controlled and optimized rates in response to the signals from the respective at least one sensor means.

In another form of the invention, a method of collecting vapors displaced by volatile liquids such as hydrocarbon fluids for vehicles during the dispensing of the volatile liquids is disclosed, comprising the steps of (while flowing the liquid into a tank): suctioning gasses from a location near the tank opening at a rate, measuring the effect of the suctioning and adjusting the rate of the suctioning based on the measured effect so as to maximize the suctioning of the vapors displaced from the tank during filling and minimize the suctioning of atmospheric air.

In another form of the invention, a method of collecting vapors displaced by volatile liquids such as hydrocarbon fuels for vehicles during the dispensing of the volatile liquids is disclosed, comprising the steps of (while flowing the liquid into a tank): suctioning gasses from a location near the tank opening at a variable rate, measuring the rate of flow of the liquid, measuring the effect of the suctioning and adjusting the rate of the suctioning, based on the measured rate of flow of the liquid and on the measured effect of the suctioning, so as to maximize the suctioning of the vapors displaced from the tank during filling and minimize the suctioning of atmospheric air.

BRIEF DESCRIPTION OF THE DRAWINGS

These and other objects, features and advantages of the invention will be apparent to those skilled in the art from the following Detailed Description taken together with the accompanied drawings in which.

DETAILED DESCRIPTION OF THE DRAWINGS

Figure 1:
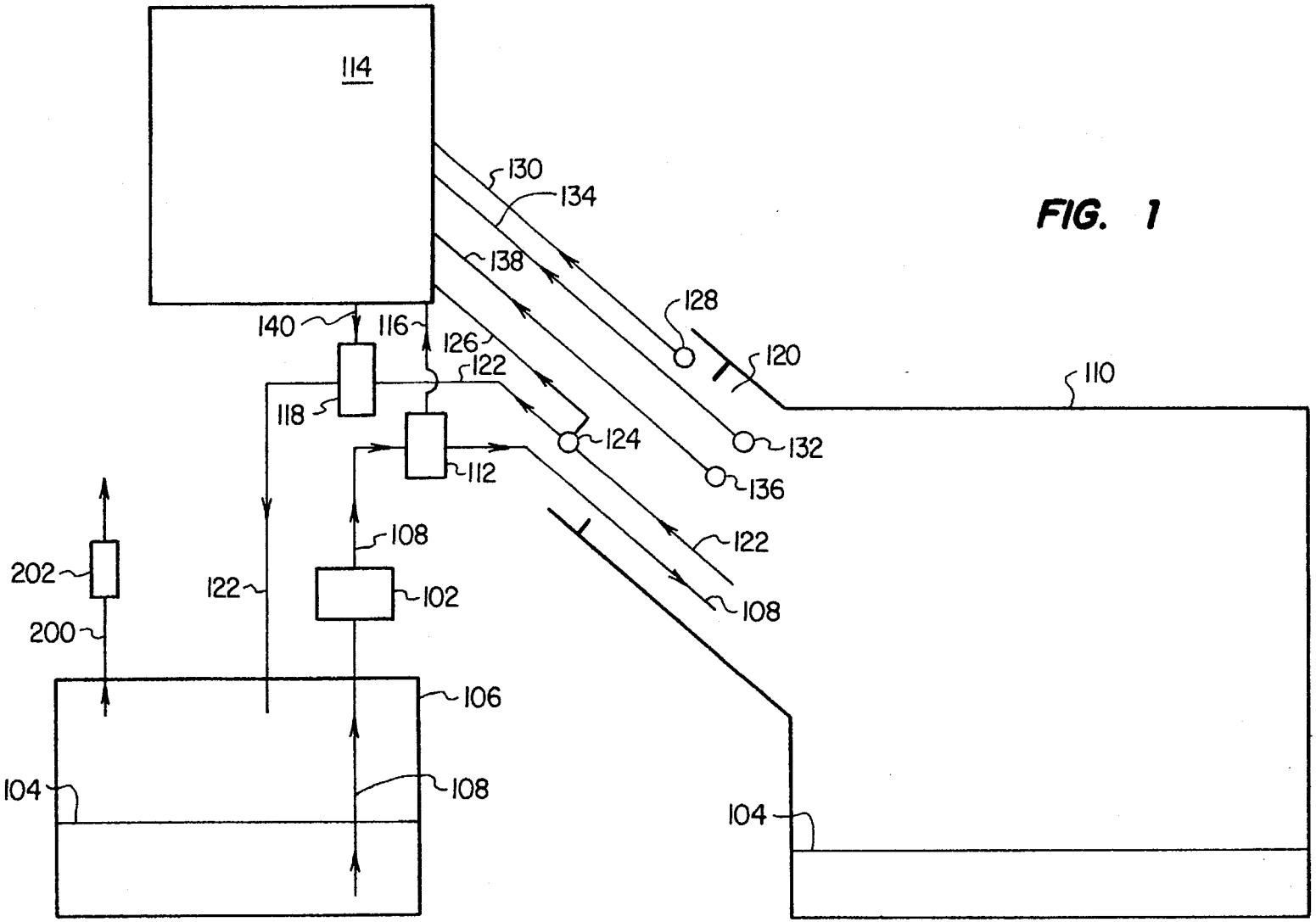
FIG. 1 is a schematic diagram of a preferred embodiment of the invention.

A liquid fuel dispenser in accordance with the present invention is shown schematically in FIG. 1. A pump 102 delivers fuel 104 from a storage tank 106 along fuel conduit 108 to a tank 110 being filled. The fuel moving through conduit 108 passes through flow meter 112 which sends a signal representing the rate of fluid flow to controller 114 along signal line 116. A variable rate vapor pump 118 withdraws gasses from near the opening 120 of tank 110 along vapor conduit 122 from which the gasses are discharged into storage tank 106. Excess pressure in the storage tank 106 is relieved through discharge conduit 200 as allowed by pressure relief valve 202, or may be disposed of in any other suitable manner.

At any given time, the interior of tank 110 consists of a quantity of fuel 104, with the remaining volume of tank 110 being filled with fuel vapor in a relatively steady-state condition. As a first quantity of fuel 104 is added to tank 110, a second quantity of fuel vapor is thereby displaced out of the tank opening 120. It is these displaced fuel vapors that the variable rate vapor pump 118 scavenges. In order to precisely control this scavenging process, a controller 114 and various associated sensors are provided as described hereinbelow. Controller 114 insures that the majority of the displaced fuel vapors are scavenged by the variable rate vapor pump 118, while at the same time insuring that excess air is not scavenged. This is very important because the scavenging of atmospheric air into storage tank 106 can create a dangerous fuel vapor/air mixture and may pressurize the tank 106. Accordingly, the controller 114 and associated sensors described hereinbelow are provided.

Vapor/air ratio sensor 124 senses the fuel vapor/air ratio of the gasses being withdrawn through vapor conduit 122 and sends a signal representative of that ratio to controller 114 along signal line 126. Vapor/air ratio sensor 128 senses the fuel vapor/air ratio immediately outside opening 120 and sends a signal representing that ratio to controller 114 along signal line 130. Vapor/air ratio sensor 132 senses the fuel vapor/air ratio inside tank 110 and sends a signal representing that ratio to controller 114 along signal line 134. Pressure sensor 136 senses the pressure inside tank 110 relative to atmosphere and sends a signal representative of that pressure to controller 114 along signal line 138. The four sensors 124, 128, 132 and 136 are summarized in Table 1.

TABLE 1

Parameter Sensor Summary

| Parameter | Location | Optimum Condition |
|---|---|---|
| fuel vapor/air (sensor 128) | outside opening 120 | minimum non-zero |
| fuel vapor/air (sensor 132) | inside opening 120 | maximum |
| fuel vapor/air (sensor 124) | inside return pipe | maximum |
| pressure relative to atmospheric (sensor 136) | inside opening 120 | minimum negative pressure |

Fuel vapor/air ratio sensors 124, 128 and 132 may be any suitable gas contaminant sensor as is commonly known in the art. For example, the TGS800 air contaminant sensor manufactured by Figaro U.S.A., Inc. (P.O. Box 357, Wilmette, Ill. 60091) is accurate to less than 10 ppm for gasoline vapors. A suitable pressure sensor 136 would be ASH XLdp-D-025-C-O-MB 2-15-B-010 pressure transmitter manufactured by Industrial Instrument Division of Dresser Industries, Inc. (250 East Main Street, Stratford, Conn. 06497).

Controller 114 controls the rate of operation of variable rate vapor pump 118 through control line 140. Controller 114 may use the signal from flowmeter 112 to determine a base rate at which to operate variable rate vapor pump 118, which rate is then adjusted as needed as indicated by the signals from the various sensors 124, 128, 132 and 136. Controller 114 is designed to control the rate of operation of variable rate vapor pump 118 so as to minimize the amount of fuel vapor that escapes to the atmosphere as detected by sensor 128 and to minimize the amount of air contained in the gasses withdrawn along vapor conduit 122 as detected by sensor 124. Controller 114 also is designed to minimize the negative pressure within tank 110 as sensed by sensor 136 and to maximize the vapor/air ratio within tank 110 as sensed by sensor 132. Controller 114 may be any suitable device for implementing the control procedures described herein. For example, controller 114 may be an analog control circuit or a digital microprocessor controller as commonly known in the art. In addition to the control function described above, the controller 114 may indicate an out-of-tolerance parameter, or take other action such as an alarm or shutdown.

For example, controller 114 is designed to maximize the fuel vapor/air ratio detected by sensor 124 inside vapor conduit 122. Such maximization is preferably achieved by controlling the speed of the variable rate vapor pump 118 by control line 140. Increasing the rate of vapor pump 118 will increase the fuel vapor/air ratio sensed by sensor 124, but only up to a certain point. At some pump rate, the vapor pump 118 will be scavenging all of the displaced fuel vapors and any increase in pump rate will result in a greater intake of atmospheric air, thereby reducing the fuel vapor/air ratio sensed by sensor 124. Controller 114 therefore maintains the pump rate (via control line 140) which will maximize the fuel vapor/air ratio sensed by sensor 124.

By analogous methods, controller 114 minimizes the fuel vapor/air ratio sensed by sensor 128 outside tank opening 120, maximizes the fuel vapor/air ratio sensed by sensor 132 inside tank opening 120, and maintains a minimum negative pressure (with respect to atmospheric pressure) at sensor 136 inside tank opening 120.

In a first alternative embodiment, the controller 114 relies only upon the signals from sensors 124, 128, 132 and 136 to control the rate of vapor pump 118, thus signal line 116 is omitted.

In a second alternative embodiment, less than all of the sensors 124, 128, 132 and 136 may be used in any combination to provide respective signals which are used by the controller 114 to set the rate of the vapor pump 118.

In a third alternative embodiment, the variable rate vapor pump 118 may be replaced with a variable vapor valve (not shown) operating in conjunction with a fixed or variable rate vapor pump to control the rate of intake of vapors from tank 110. In such a configuration, both the variable vapor valve and the fixed or variable rate vapor pump would be under the control of the controller 114.

In a fourth alternative embodiment, a single controller 114 may be used to control multiple vapor pumps 118 coupled to several respective fuel dispensers in conjunction with a fueling station. Each such fuel dispenser would provide independent sensor signals to the single controller 114.

In a fifth alternative embodiment, a single controller 114 may be used to control a single vapor pump 118 coupled to several fuel dispensers by means of several respective variable vapor valves. Each such fuel dispenser would provide independent sensor signals to the single controller 114.

Figure 2:
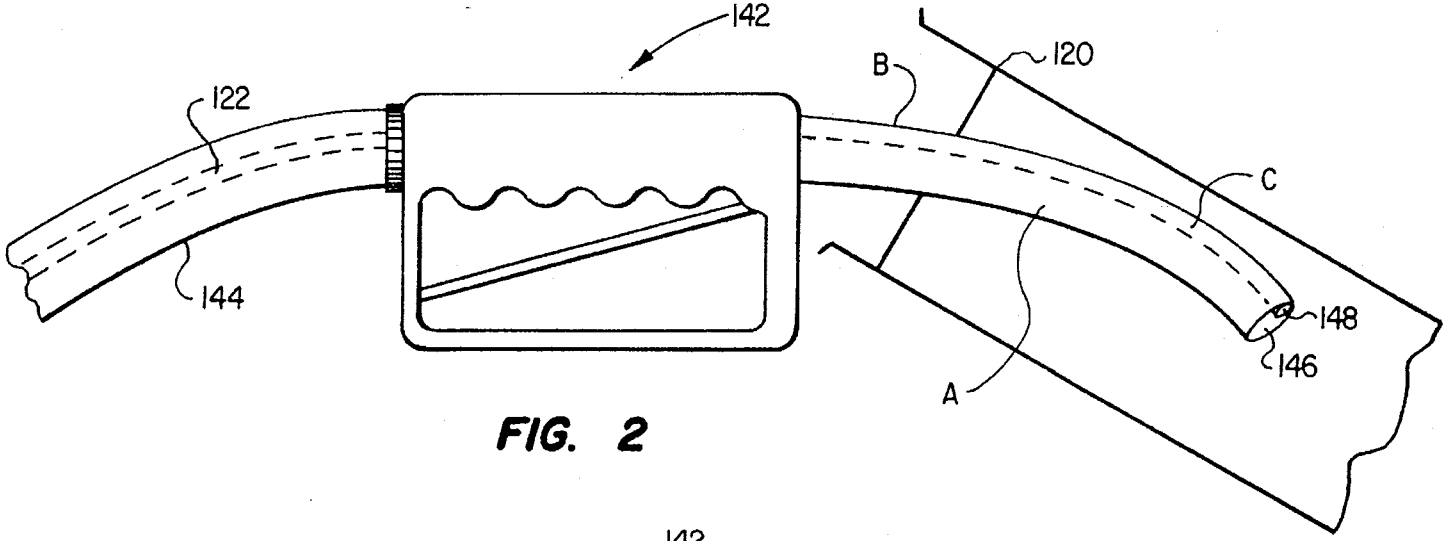
FIG. 2 is an illustration of the first embodiment positions of the vapor intake means and sensing locations as applied to a typical gasoline dispensing apparatus in accordance with the present invention.

FIG. 2 shows where, on a traditional bellowless dispensing apparatus (i.e. no seal between the nozzle and the filler pipe), the vapor conduit and the sensing points of the various sensors may be fixed to sense the pressure and fuel vapor/air ratios at the desired locations. As shown in FIG. 2, a typical nozzle and liquid valve apparatus 142 is connected to a dual conduit hose 144 so as to allow fuel to be dispensed through aperture 146 and vapor to be withdrawn through aperture 148. The pressure sensor 136 and vapor/air ratio sensor 132 for detecting the fuel vapor/air ratio inside the tank can be mounted on the nozzle so as to sense their respective qualities at a location A on the exterior of the nozzle. The vapor/air ratio sensor 128 for sensing the fuel vapor/air ratio immediately outside the tank opening 120 can be mounted on the nozzle so as to sense the fuel vapor/air ratio outside the nozzle at location B. The vapor/air ratio sensor 124 for sensing the fuel vapor/air ratio of the recovered gasses can be mounted on the nozzle so as to sense the vapor to air ratio at location C inside the vapor conduit 122. Alternatively, the vapor/air ratio sensor 124 may be mounted inside the vapor return pipe inside the fuel dispenser rather than at the nozzle.

In this way, all of the required sensors may be located on the dispensing apparatus 142 itself, thereby obviating the need for special sensors and connections in or on the receptacle tank 110. This is especially desirable for use of the invention in conjunction with public, general purpose fueling stations where retrofitting of sensors into receptacle tanks 110 is not practicable.

Figure 3:
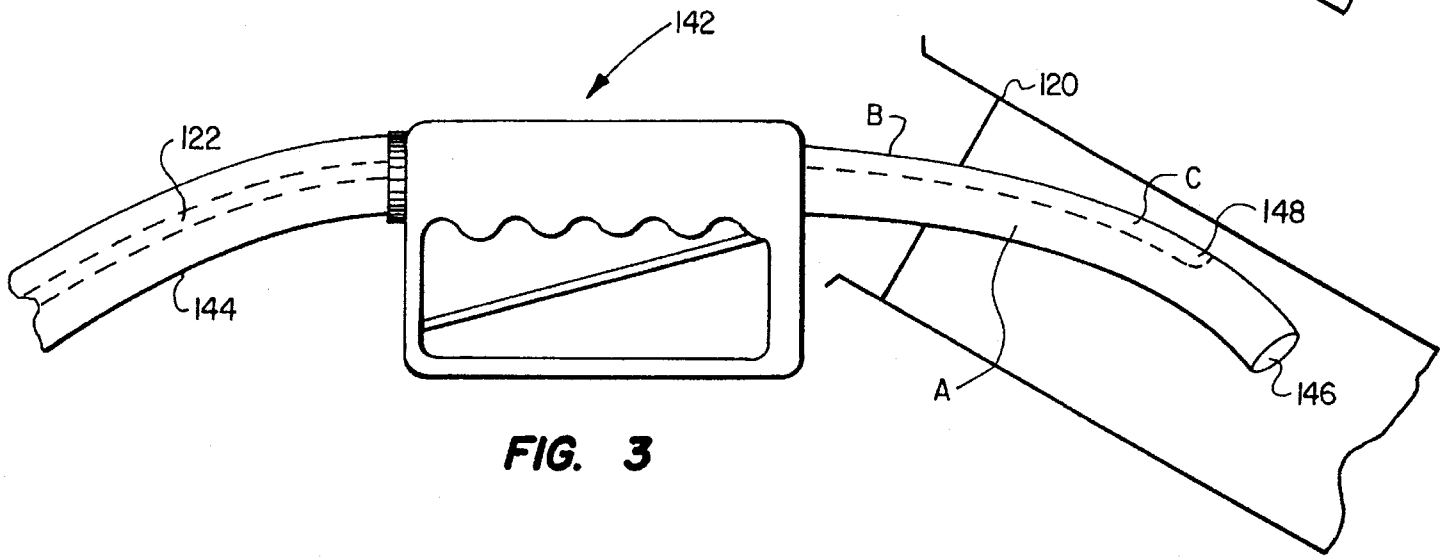
FIG. 3 is an illustration of the second embodiment positions of the vapor intake means and sensing locations as applied to a typical gasoline dispensing apparatus in accordance with the present invention.

An alternative embodiment bellowless dispensing apparatus is shown in FIG. 3. The typical nozzle and liquid valve apparatus 142 is connected to a dual conduit hose 144 so as to allow fuel to be dispensed through aperture 146 and vapor to be withdrawn through aperture 148 formed in the body of the nozzle. The pressure sensor 136 and vapor/air ratio sensor 132 for detecting the fuel vapor/air ratio inside the tank can be mounted on the nozzle so as to sense their respective qualities at a location A on the exterior of the nozzle. The vapor/air ratio sensor 128 for sensing the fuel vapor/air ratio immediately outside the tank opening 120 can be mounted on the nozzle so as to sense the fuel vapor/air ratio outside the nozzle at location B. The vapor/air ratio sensor 124 for sensing the fuel vapor/air ratio of the recovered gasses can be mounted on the nozzle so as to sense the vapor to air ratio at location C inside the vapor conduit 122. Alternatively, the vapor/air ratio sensor 124 may be mounted inside the vapor return pipe inside the fuel dispenser rather than at the nozzle.

Although preferred embodiments of the invention have been described in detail, it is to be understood that various changes, substitutions and alterations can be made therein without departing from the spirit and scope of the invention as defined by the appended claims.

What is claimed is:

1. A dispensing system for dispensing volatile liquids such as hydrocarbon fluids for vehicles while collecting vapors to reduce atmospheric pollution comprising:

(a) at least one liquid dispensing means having a nozzle and liquid valve means for flowing liquid into a tank;

(b) vapor collection means, associated with the nozzle and liquid valve means, for collecting the vapors displaced from the tank during filling;

(c) at least one vapor/air ratio sensor means for directly monitoring operation of the vapor collection means and for providing signals representative of said operation;

(d) a pressure sensor for sensing, immediately inside an opening of the tank, a pressure relative to atmosphere, and for producing a signal representative of said pressure;

(e) controller means for receiving the signals from each of the respective at least one vapor/air ratio sensor means and said pressure sensor, the controller means adjusting the rate of operation of the respective vapor collection means so as to maintain the pressure relative to atmosphere, inside the respective tank being filled, as close to zero on the negative side as possible.

2. The dispensing system of claim 1 wherein each of said at least one vapor/air ratio sensor means comprises:

a sensor for sensing, when the nozzle and liquid valve means is engaged with the tank, a fuel vapor/air ratio immediately outside an opening of the tank, and for producing a signal representative of said fuel vapor/air ratio;

each said signal being received by the controller means, the controller means adjusting the rate of operation of the respective vapor collection means so as to maintain the fuel vapor/air ratio at said sensor as close to zero on the positive side as possible.

3. The dispensing system of claim 1 wherein each of said at least one vapor/air ratio sensor means comprises:

a sensor for sensing a fuel vapor/air ratio inside the vapor collection means, and for producing a signal representative of said fuel vapor/air ratio;

each said signal being received by the controller means, the controller means adjusting the rate of operation of the respective vapor collection means so as to maintain the fuel vapor/air ratio at said sensor as positive as possible.

4. The dispensing system of claim 1 wherein each of said at least one vapor/air ratio sensor means comprises:

a sensor for sensing a fuel vapor/air ratio immediately inside an opening of the tank, and for producing a signal representative of said fuel vapor/air ratio;

each said signal being received by the controller means, the controller means adjusting the rate of operation of the respective vapor collection means so as to maintain the fuel vapor/air ratio at said sensor as positive as possible.

5. The dispensing system of claim 1 wherein each liquid dispensing means further comprises:

flow meter means for producing a signal representative of the rate of flow of liquid being dispensed from the nozzle and liquid valve means;

each said signal being received by the controller means for use as an input in individually optimizing the rate of collection of vapors by the respective vapor collections means.

6. The dispensing system of claim 1 wherein said vapor collection means comprises:

(a) vapor intake means for taking in vapors displaced from the tank, the vapor intake means being associated with the nozzle and liquid valve means and positioned to be near the opening of the tank during filling, and (b) a variable rate vapor pump coupled to draw vapor from the vapor intake means and to deliver the vapor to vapor storage means, each respective variable rate vapor pump being operated individually by the controller means in response to the signals received from the respective at least one sensor means.

7. The dispensing system of claim 1 wherein said vapor collection means comprises: vapor valve means, coupled to control the flow of vapor through the vapor intake means and operated by the controller means, for varying the rate at which vapor is collected through the vapor intake means.

8. A dispensing system for dispensing volatile liquids such as hydrocarbon fluids for vehicles while collecting vapors to reduce atmospheric pollution comprising:

(a) at least one liquid dispensing means having a nozzle and liquid valve means for flowing liquid into a tank;

(b) vapor collection means, associated with the nozzle and liquid valve means, for collecting the vapors displaced from the tank during filling; and (c) at least one sensor means for directly monitoring operation of the vapor collection means and for providing signals representative of said operation; wherein said at least one sensor means comprises:

(i) a first sensor for sensing, when the nozzle and liquid valve means is engaged with the tank, a first fuel vapor/air ratio immediately outside an opening of the tank, and for producing a first signal representative of said first fuel vapor/air ratio;

(ii) a second sensor for sensing a second fuel vapor/air ratio inside the vapor collection means, and for producing a second signal representative of said second fuel vapor/air ratio;

(iii) a third sensor for sensing a third fuel vapor/air ratio immediately inside an opening of the tank, and for producing a third signal representative of said third fuel vapor/air ratio;

(iv) a fourth sensor for sensing, immediately inside an opening of the tank, a pressure relative to atmosphere, and for producing a fourth signal representative of said pressure;

(d) controller means for receiving the signals from each of the respective at least one sensor means and operating the respective vapor collection means at individually controlled and optimized rates in response to the signals from the respective at least one sensor means wherein each said first signal being received by the controller means, the controller means adjusting the rate of operation of the respective vapor collection means so as to maintain the first fuel vapor/air ratio at said first sensor as close to zero on the positive side as possible; each said second and third signal being received by the controller means, the controller means adjusting the rate of operation of the respective vapor collection means so as to maintain the second and third fuel vapor/air ratio at said second and third sensor as positive as possible; each said fourth signal being received by the controller means, the controller means adjusting the rate of operation of the respective vapor collection means so as to maintain the pressure relative to atmosphere, inside the respective tank being filled, as close to zero on the negative side as possible.

* * * * *